United States Patent [19]

Ray

[11] Patent Number: 4,491,819

[45] Date of Patent: Jan. 1, 1985

[54] MAGNETICALLY BIASED INDUCTOR

[75] Inventor: Glen Ray, Big Bend, Wis.

[73] Assignee: Allen-Bradley Company, Milwaukee, Wis.

[21] Appl. No.: 530,018

[22] Filed: Sep. 7, 1983

[51] Int. Cl.[3] ..... H01F 27/36

[52] U.S. Cl. ..... 336/110; 336/84 R; 336/84 M; 336/155; 336/165

[58] Field of Search ..... 336/84 R, 84 M, 110, 336/155, 165, 212, 215

[56] References Cited

U.S. PATENT DOCUMENTS

| | | | |
|---|---|---|---|
| 2,869,050 | 1/1959 | Van Urk et al. | 336/155 X |
| 3,209,295 | 9/1965 | Baermann | 336/155 |
| 3,519,918 | 7/1970 | Bruck | 323/89 |
| 3,631,534 | 12/1971 | Hirota et al. | 336/155 |
| 3,968,465 | 7/1976 | Fukui et al. | 336/110 |
| 4,009,460 | 2/1977 | Fukui et al. | 336/110 |
| 4,152,637 | 5/1979 | Oberbeck et al. | 323/6 |

FOREIGN PATENT DOCUMENTS

| | | | |
|---|---|---|---|
| 725329 | 3/1955 | United Kingdom | 336/110 |
| 1288273 | 9/1972 | United Kingdom | 336/155 |

OTHER PUBLICATIONS

"Designing Optimum Inductors with Ferrite Biased Gaps", by J. T. Ludwig.

"Reverse-Biased Ferrite Cores", by S. F. Shiraki/Electronic Design, 7/19/78.

"A New Reverse-Biased Choke Coil", by Akio Nakamura, et al., Proceedings of Power Con 9, 1982.

Sales Literature, "Hitachi Magnet Biased Choke Coils and Transformers", by Hitachi Magnetics Corp., 1978.

*Primary Examiner*—A. D. Pellinen

*Assistant Examiner*—Susan A. Steward

*Attorney, Agent, or Firm*—Barry E. Sammons

[57] ABSTRACT

An inductor having an air gap in its magnetic core is provided with a magnetic shield which surrounds the inductor air gap to not only reverse bias the inductor magnetic circuit so as to increase the amount of current required to achieve inductor saturation but also to return any stray flux radiating from the inductor back into the inductor magnetic circuit to reduce the radiated electromagnetic interference.

7 Claims, 9 Drawing Figures

FIG. 1
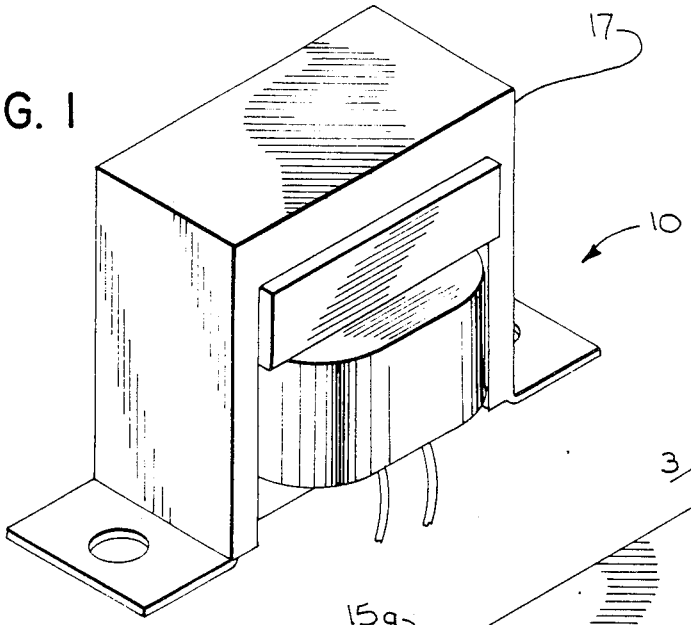
FIG. 2
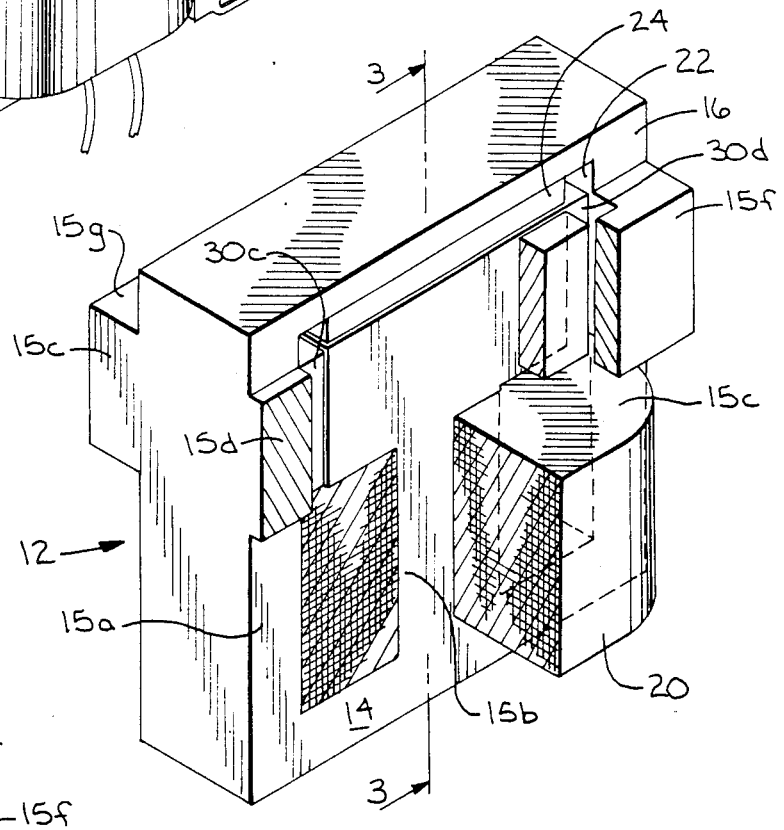
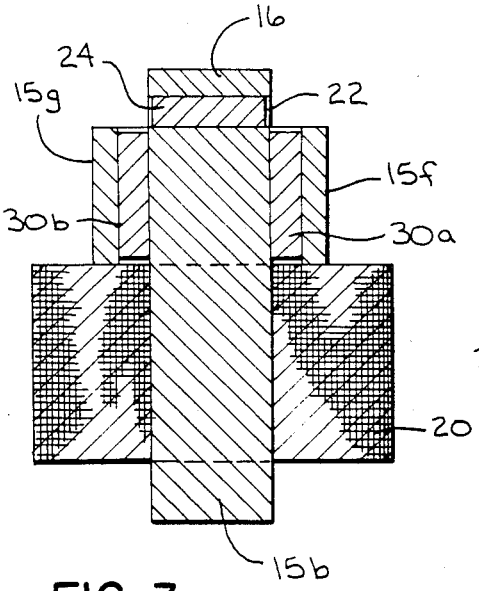
FIG. 3
FIG. 4
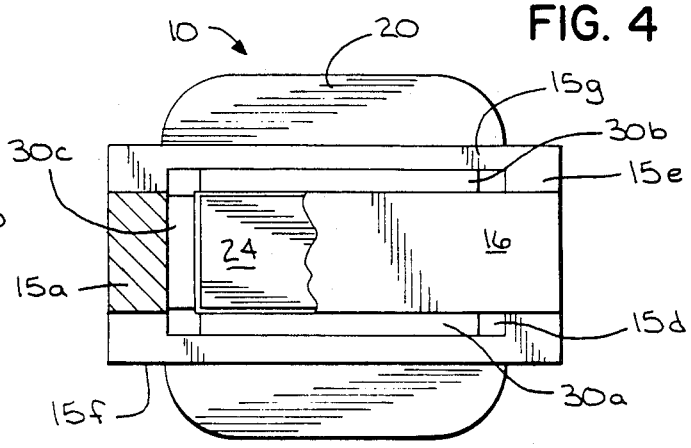

MAGNETICALLY BIASED INDUCTOR

BACKGROUND OF THE INVENTION

This invention relates generally to inductors and more specifically to a magnetically biased inductor, which is well suited for use as a filter choke in a motor drive system.

In motor drive systems, an inductor, usually taking the form of a filter choke, is coupled between the power supply and the inverter to filter the incoming inverter current. For the filter choke inductor to function effectively, the filter choke inductor must be properly sized, that is to say, the inductance and current rating of the filter choke inductor must be selected so that the filter choke inductor does not become magnetically saturated under normal current loads. At saturation, very little additional magnetic flux may permeate the magnetic circuit of the inductor, thus decreasing the incremental inductor inductance which lessens the ability of the inductor to filter ripple. Therefore, it is desirable to size the filter choke inductor so that at desired current amplitude, the inductor remains unsaturated.

To increase the current rating of an iron core filter choke inductor, a common practice is to provide an air gap within the inductor magnetic circuit. The presence of an air gap serves to decrease the overall magnetic permeability which in turn serves to decrease the inductance while increasing the current rating of the inductor. When an air gap is present in the magnetic circuit, the overall inductor reluctance is increased so that more magneto motive force (M.M.F.) is required to saturate the inductor as compared to the amount of M.M.F. required to saturate a closed path, that is to say a non air gap iron core inductor. Since the magnetic flux created in the inductor magnetic circuit is directly related to the current in the inductor, increasing the amount of M.M.F. required to saturate the inductor translates directly into an increased inductor current rating. However, the air gap reduces the overall magnetic permeability of the inductor, thereby decreasing the incremental inductance of the inductor. Thus, to obtain the same rated inductance, the air gap filter choke inductor must have a larger magnetic circuit in comparison with a closed path iron core filter choke inductor thereby increasing the overall inductor construction cost.

In an effort to obtain the advantages of an air gap inductor, namely an increased current rating without its associated disadvantage of decreased inductance, magnetically biased inductors have been developed. In the past the magnetically biased inductor has been fabricated by placing a rare earth magnet within the air gap such that the rare earth magnet M.M.F. opposes the M.M.F. of the inductor magnetic circuit. The presence of a rare earth magnet within the air gap of the inductor magnetic surface effectively serves to reverse bias the inductor magnetic circuit so that a greater amount of M.M.F. is required to saturate the inductor magnetic circuit as compared to the same inductor having an unfilled air gap. Yet, the presence of the rare earth magnet does not significantly change the overall magnetic permeability of the inductor magnetic circuit so that the inductor inductance is not diminished. Thus, by adding a rare earth magnet within the air gap of the inductor magnetic circuit, the current rating of the inductor is effectively increased, without adversely affecting the inductor inductance.

Magnetically biased inductors employing rare earth magnets are relatively expensive, due to the high cost of rare earth permanent magnet material. Moreover, although magnetically biased inductors radiate less electromagnetic interference than do conventional air gap inductors, the amount of electromagnetic interference radiated by a rare earth-magnetically biased inductor may still adversely affect the operation of other circuit components.

BRIEF SUMMARY OF THE INVENTION

In contrast to prior art air gap inductors, and rare earth magnetically-biased inductors, the present invention is directed to a inductor having a ferrite magnet shield disposed in and about the air gap of the inductor magnetic circuit. The ferrite magnet shield not only serves to reverse bias the inductor magnetic circuit, but also serves as a return path for any stray magnetic flux to return the flux to the inductor, thereby reducing the radiated electromagnetic interference.

Accordingly, it is an object of the present invention to provide an improved magnetically biased inductor which is less expensive to fabricate than present day rare earth magnetically biased inductors. The ferrite magnet shield disposed partially within the air gap is formed from inexpensive ferrite magnets which are arranged to form a cap like structure about at least a portion of the inductor core to reverse bias of the inductor magnetic circuit in a manner equivalent to that achieved by present day rare earth magnets, without the associated high costs of such magnets.

It is another object of the present invention to provide an improved magnetically biased inductor whose radiated electromagnetic interference is much reduced in comparison with present day rare earth magnetically biased inductors. By providing a ferrite magnet shield about the inductor core, the majority of stray magnetic flux lines are returned to the inductor magnetic circuit through the shield so as to greatly reduce any radiated electromagnetic interference.

Other objects and advantages of the present invention will become readily apparent from the foregoing specification.

BRIEF DESCRIPTION OF THE DRAWINGS

The features of the invention believed to be novel are set forth with particularity in the appended claims. The invention itself, however, both as to organization and method of operation, together with further objects and advantages thereof, may best be understood by reference to the following description taken in conjunction with the accompanying drawings in which:

FIG. 1 is a perspective view of magnetically biased inductor of the present invention;

FIG. 2 is a perspective, cutaway view of the core of the inductor of FIG. 1;

FIG. 3 is a cross sectional view of the inductor core taken along the lines 3—3 of FIG. 2;

FIG. 4 is a cutaway top view of the inductor of FIG. 1;

DETAILED DESCRIPTION OF THE PREFERRED EMBODIMENT

Figure 5A:
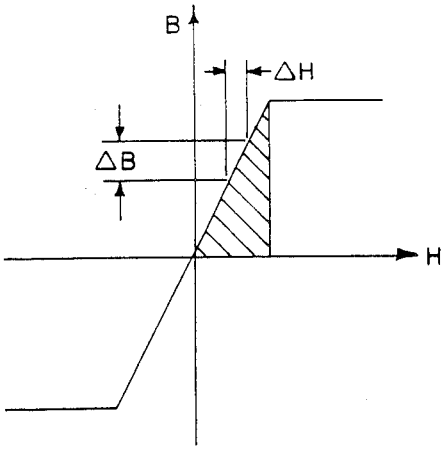
FIGS. 5*a* and 5*b* are graphical representations of the B-H curve for a conventional iron core inductor and for an iron core inductor having an air gap in its magnetic circuit, respectively.

Referring now to the figures, and especially FIG. 1, there is shown an improved magnetically biased inductor 10 which takes the form of a filter choke typically used within an inductor drive system or the like for filtering the incoming inverter current. The inductor 10 of the present invention comprises a magnetically permeable core 12 (illustrated in FIG. 2) which includes a first core member 14 having upstanding legs 15*a*, 15*b* and 15*c* so as to resemble an inverted "E". The central leg 15*b* of the core member 16 is "T" shaped in contrast to the outer legs 15*a* and 15*c* which are each of a uniform thickness.

At the top of each of core legs 15*a* and 15*c* are forwardly and rearwardly extending protrusions 15*d* and 15*e*, respectively (the rearwardly extending protrusion of leg 15*e* only illustrated in FIG. 4). Horizontal section 15*f* extends between the forward protrusions 15*d* of legs 15*a* and 15*c* whereas horizontal section 15*g* extends between the rearwardly protrusions 15*e* of legs 15*a* and 15*c*. In practice, the protrusions 15*d* and 15*e* and the horizontal sections 15*f* and 15*g* are integral with the legs 15*a* and 15*c*. A bridge member 16, which is shaped similar to an inverted "I", rests upon the outermost legs 15*a* and 15*c* of the core member 14 to provide a return path for the magnetic flux permeating legs 15*a* and 15*c* of the core 14. The "E" shape of the core member 14 and the "I" shape of the bridge 16 give rise to the designation of inductor 10 as being an "E-I" type inductor.

Core member 14 and bridge 16 are constructed of silicon steel or the like. In practice, the core 14 and the bridge 16 are comprised of silicon steel laminations rather than a solid member as the laminated construction serves to reduce any eddy current losses. The bridge 16 is typically secured to the top of the core 14 by way of a steel shell 17 illustrated in FIG. 1.

Wrapped about the central leg 15*b* of the inductor core 14 is a coil 20 which, in practice, is coupled in series between the phase controlled rectifier and inverter of an AC motor drive system. When energized with a d.c. voltage, the coil 20 generates a magnetic field whose flux lines radiate from the central leg 15*b* and through the bridge 16 before returning via the outer legs 15*a* and 15*c* of the core 14.

The central leg 15*b* of the core 14 is purposely made shorter than each of the outer legs 15*a* and 15*c* so as to create an air gap 22 between the bridge 16 and the top of the central leg 15*b*. The presence of the air gap 22 within the inductor magnetic circuit serves to increase the overall reluctance of the inductor circuit. An increase in the inductor reluctance results in a smaller flux density (B) for a given field intensity (H). This may be better appreciated by reference to FIG. 5*a* which illustrates the B-H curve for an inductor without an air gap and to FIG. 5*b* which illustrates the B-H curve for the air gap inductor. In each Figure, the inductor usable range is represented by the shaded area under the curve. The magnetic flux density (H), is proportional to the inductor current (I) and thus by comparison of FIGS. 5*a* and 5*b*, the air gap inductor achieves an increased current rating since a greater magnetic field density and hence current are required to achieve saturation of the air gap inductor as compared to the non air gap inductor.

Figure 5B:
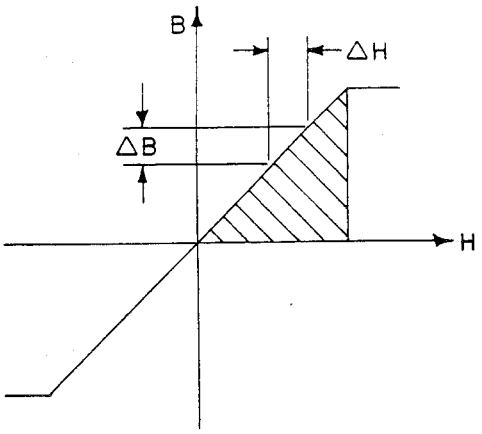

However, increasing the inductor magnetic circuit reluctance by providing an air gap between the central leg 15*b* and the bridge 16 reduces the permeability of the inductor magnetic circuit which results in a reduced inductance rating because of the reduced incremental inductance which is attributable to the reduced slope (B/H) of the curve in FIG. 5*b* as compared to the slope (B/H) in FIG. 5*a* of the curve. Moreover, since the inductor current is assumed to be of a positive polarity during normal operation, the relationship between the inductor flux density B and the inductor magnetic field intensity H is limited to the first quadrant of the B-H curve of FIG. 5*b* thereby limiting the range of the inductor as represented by the shaded area under the curve. Another disadvantage attributable to the presence of the air gap 22 within the inductor magnetic circuit is that the air gap gives rise to fringe flux lines (not shown) which cause electromagnetic interference. Generally such interference is undesirable and may cause other circuit components to react adversely.

To ameliorate the disadvantages of having an air gap such as air gap 22 within the inductor magnetic circuit, while still enjoying the advantage attributable to the air gap, namely an increased inductor current rating, a magnet 24 is interposed within the air gap 22 between the bridge 16 and the top of leg 15*b* so that the magnetic field of the magnet 24 opposes the magnetic field of the inductor magnetic circuit when coil 20 is energized with a direct current voltage. The opposing magnetic flux magnet 24 effectively "reverse biases" the inductor magnetic circuit, that is to say, the flux of magnet 24 cancels a portion of the inductor flux. Reverse-biasing the inductor magnetic circuit in this manner reduces the overall magnetic flux that permeates the inductor so that more current may pass through the inductor before saturation occurs in contrast to a conventional closed iron core inductor. However, reverse-biasing the inductor magnetic circuit does not increase the inductor reluctance so that the inductor inductance is not adversely affected.

Figure 6:
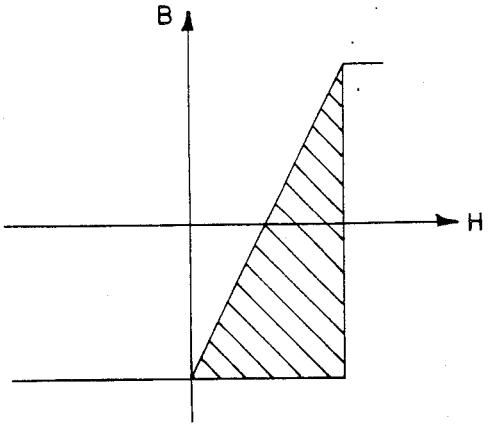
FIG. 6 is a graphical representation of the B-H curve for a magnetically biased inductor.

To better understand the effects of reverse biasing an inductor by placing a magnet within the air gap (such as placing magnet 24 illustrated in FIGS. 2, 3 and 4 within air gap 22), reference should be had to FIG. 6 which is a graphical representation of the magnetic flux density B as a function of the magnetic field intensity H for a magnetically biased inductor. In comparison with the B-H curve illustrated in FIGS. 5*a* and 5*b*, the B-H curve of FIG. 6 appears offset which is attributable to the flux produced by the magnet 24 within the air gap. As a consequence of this "negative" flux, the magnetic field intensity B at the zero H valve appears negative. Thus, the lower half of the B-H curve which is not utilized in the case of the conventional air gap inductor as discussed previously with respect to FIG. 5 can in fact be utilized in the magnetically biased air gap inductor, thereby effectively extending the inductor range. By comparing the useful range of the magnetically biased inductor, which is illustrated by the shaded area under the curve of FIG. 6 to the useful range of both the air gap and non air gap inductors, which are each represented by the shaded area under the curve of each of FIGS. 5*a* and 5*b*, the magnetically biased inductor may be seen to have a much greater usable range.

Heretofore, magnets utilized to magnetically bias an inductor have been fabricated from rare earth permanent magnetic materials, such as cobalt-samarium. However, such rare earth permanent magnetic materials are very scarce and accordingly are very expensive. In an effort to reduce the expense of prior art magnetically biased inductors, the permanent magnet 24 within the air gap 22 of inductor 10 is manufactured from an inexpensive ferrite magnetic material, typically one having a Br valve of 2900 and an HCi value of 5800. Ordinarily, the flux density of the ferrite magnet material utilized to fabricate the magnet 24 is relatively low, on the order of 3000–4000 gauss in comparison to the flux density of the silicon steel utilized to fabricate bridge 16 and core 14 which typically has a flux density of 15,000–18,000. Thus, the single ferrite magnet 24 interposed within the air gap 22 of the inductor 10 may not be of sufficient strength to magnetically reverse bias the inductor. Empirical testing has determined that the cross sectional area of the ferrite magnet must be 5 to 7 times as great as that of the air gap to achieve the desired reverse magnetic biasing of the inductor. To achieve the desired ratio of the ferrite magnet area to the air gap area, four additional ferrite magnets 30*a*, 30*b*, 30*c* and 30*d*, each fabricated similar to magnet 24, are positioned adjacent to the central leg 15*b* of the core 14 beneath the air gap. These magnets increase the overall ratio of the ferrite magnet area to the air gap area to achieve the desired reverse biasing of the inductor.

Magnets 30*a* and 30*b* are positioned between horizontal core sections 15*f* and 15*g* so that each of magnets 30*a* and 30*b* is next to an opposing one of the sides of the top of the central leg 15*b* of the inductor core just beneath the air gap 22. Magnets 30*c* and 30*d* are positioned between the ends of legs 15*a* and 15*b* and legs 15*b* and 15*c*, respectively, and just beneath the air gap 22. Magnets 30*a*–30*d* are oriented such that the magnetic flux of each magnet opposes the magnetic flux of the inductor magnetic circuit.

The ferrite magnet biased inductor 10 described thus far yields a significant advantage over the rare earth magnetically biased inductors of the prior art. By positioning magnets 24 and 30*a*–30*d* about the central leg 15*b* of the inductor in the manner described above, the magnets form a magnetic shield which serves not only to reverse bias the inductor magnetic circuit but also serves to effectively shield the air gap 22 so that any fringing magnetic flux is returned through the magnets to the inductor magnetic circuit. This in turn reduces the radiated electromagnetic interference.

The magnetic shield formed by the cap-like structure of magnet 24 and magnets 30*a*–30*d* could also be formed of a unitary structure whose cross section corresponds to the cross section of the tip of leg 15*b* so as to overly the tip of leg 15*b*. Other magnetic shield arrangements are also possible.

Figure 7:
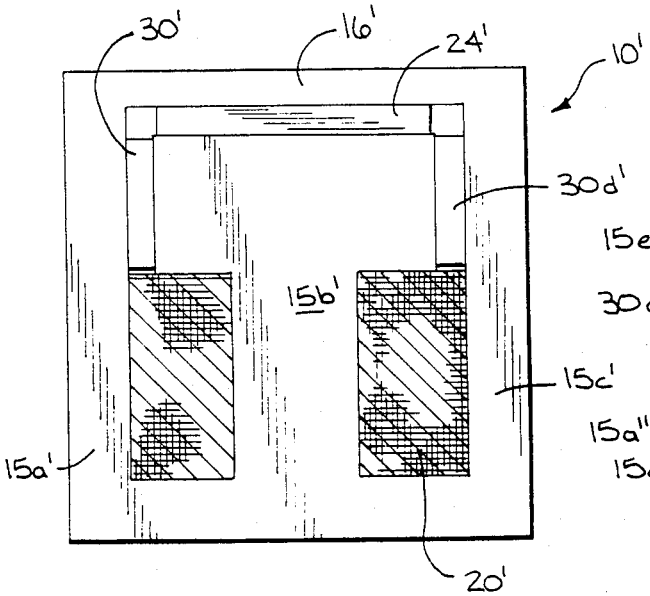
FIG. 7 is an end view of an alternative embodiment of a magnetically biased inductor constructed in accordance with the teachings of the invention.

Referring now to FIG. 7, there is shown a cross sectional end view of an alternate preferred embodiment 10' of a magnetically bias inductor. Inductor 10' is similar in its general overall construction to inductor 10 of FIGS. 1–4 so that like reference numbers are employed in FIG. 7, each followed by a prime, to identify the like elements corresponding to inductor 10 of FIGS. 1–4. The significant difference between the construction of inductor 10' of FIG. 7, as compared to inductor 10 of FIGS. 1–4 resides in the number of ferrite magnets which are utilized in each inductor to form the magnetic shield about the central core of the inductor to magnetically reverse bias the inductor as well as to provide a return path for stray magnetic flux. As described above, inductor 10 utilizes five magnets, magnet 24 interposed within the air gap 22 and magnets 30*a*–30*d* each juxtaposed the opposing side and edges of the inductor leg 15*b*. In the inductor 10' of FIG. 7, the magnetic shield is comprised of but three ferrite magnets, a magnet 24' interposed in the air gap, and a pair of magnets 30*c'* and 30*d'* each juxtaposed to a corresponding one of the edges of the central core leg 15*b'*. Magnets 24', 30*c'* and 30*d'* are arranged in a manner identical to magnets 24 and 30*c* and 30*d* so that the flux of magnets 24', 30*c'* and 30*d'* opposes the flux of the magnetic circuit of inductor 10'. The use of only three magnets within inductor 10' still enables the inductor to achieve satisfactory performance as compared to inductor 10 although the electromagnetic radiation radiated by inductor 10' is somewhat greater than that radiated by inductor 10 by virtue of the absence of magnets juxtaposed to each of the sides of the inductor core leg. However, by deleting each of the magnets juxtaposed to the sides of inductor core leg, the magnetically biased inductor 10' can be constructed more cheaply than magnetically biased inductor 10.

Figure 8:
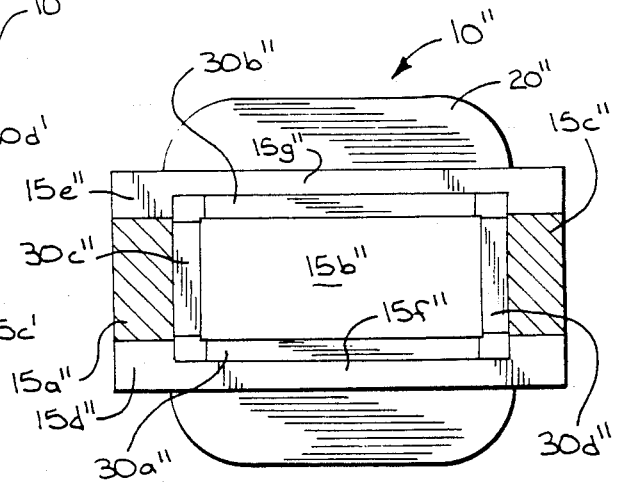
FIG. 8 is a top or plan view of yet another embodiment of a magnetically biased inductor constructed in accordance with the present invention.

FIG. 8 is a top or plan view of yet another embodiment 10'' of a magnetically biased inductor constructed in accordance with the teachings of the present invention. Magnetically biased inductor 10' shares many similarities to magnetically biased inductor 10 of FIGS. 1–4, and thus like reference numbers, followed by a double prime, are utilized in FIG. 10 to designate like elements. The significant difference between the magnetically biased inductor 10 of FIGS. 1–4 and the magnetically biased inductor 10'' of FIG. 8 is that the magnetically biased inductor 10'' is made open at its top, that is to say that the magnetically biased inductor 10' does not include a bridge element (such as bridge element 16 of FIGS. 2 and 4) nor does it include an air gap magnet (such as magnet 24 of FIGS. 2 and 3). Rather, inductor 10'' utilizes a magnetic band which is comprised of ferrite magnets 30*a''*–30*d''* which are each juxtaposed to an opposing one of the sides and edges of the central core leg 15*b* adjacent to the top edge of the central inductor core leg so that the flux of magnets 30*a''*–30*d''* opposes the flux of the inductor magnetic circuit. While the magnetic band of magnets 30*a''*–30*d''* achieves somewhat reduced shielding of electromagnetic radiation of inductor 10'' in comparison with the magnetic shielding of the electromagnetic radiation afforded to inductor 10 of FIGS. 1–4 by virtue of magnet 24 and magnets 30*a*–30*b*, the overall construction of inductor 10'' is much simpler in comparison to inductor 10 of FIGS. 1–4 which may be very advantageous. By leaving the top of inductor 10'' open, the magnets 30*a''*–30*d''* may be easily inserted in comparison to the assembly of magnets 30*a*–30*d* within the inductor 10 of FIGS. 2 and 3.

What has been disclosed thus far is a magnetically biased inductor having a magnetic shield about the inductor air gap for not only reverse biasing the magnetic circuit but for returning stray flux to reduce radiated electromagnetic interference.

While only certain preferred features of the invention have been shown by way of illustration, many modifications and changes will occur to those skilled in the art. It is, therefore, to be understood that the appended claims are intended to cover all such modifications and changes as fall within the true spirit of the invention.

What is claimed is:

1. In an E-I type inductor having a E-shaped central core with a central leg having an end, an inductor coil wrapped around a portion of the E-shaped central core to induce magnetic flux therein, and an I-shaped bridge separated from the end of the central leg of the E-shaped core by an air gap, the improvement comprising:

a ferrite magnet cap positioned over the end of the central leg of the E-shaped core so that a first portion of the magnetic cap lies within the air gap and another portion extends downward from the first portion and surrounds opposing sides and edges of the end of the central leg of the E-shaped cord adjacent the air gap, the ferrite magnet cap having a magnetic polarity which opposes the magnetic flux produced in the E-shaped central core by the indicator coil.

2. The invention according to claim 1 wherein said first portion of the ferrite magnet cap includes a first ferrite magnet interposed between the top of the central leg of the E-shaped core and the I-shaped bridge; and said another portion includes:

second and third ferrite magnets each positioned over an opposing one of the sides of the central leg of the E-shaped core adjacent the air gap; and fourth and fifth ferrite magnets each positioned over an opposing one of the edges of the central leg of the E-shaped core adjacent the air gap so as to each lie between legs of the E-shaped core.

3. The invention according to claim 2 wherein the inductor core includes extensions which overlie the second and third ferrite magnets to enclose them within the inductor core.

4. In combination with an E-I type inductor having a coil which produces a magnetic circuit flux in an E-shaped core whose central leg is separated from an I-shaped bridge by an air gap, the improvement comprising:

a ferrite magnet interposed within the air gap so that the flux of said ferrite magnet opposes the magnetic circuit flux; and a ferrite magnet band circumscribing the central leg of the E-shaped core just beneath the air gap, said ferrite magnet band being of a magnetic polarity such that the flux radiating from said band opposes magnetic circuit flux.

5. The invention according to claim 4 wherein the E-shaped core includes extensions which overlie the ferrite magnet band to enclose it within the inductor core.

6. In an E-I type inductor having a coil which produces a magnetic circuit flux in an E-shaped core having a central leg with an end which is spaced from an I-shaped bridge to form an air gap, the improvement comprising:

an air gap ferrite magnet cap which is positioned in the air gap and which extends around the end of the central leg to provide portions which are positioned between the central leg and each of the outer legs of the E-shaped core, said air gap ferrite magnet cap having a magnetic polarity which opposes the magnetic circuit flux.

7. The improvement as recited in claim 6 in which the central leg has opposing lateral extensions at its end to form a T-shape, and the air gap ferrite magnet cap extends along the top and around the ends of these lateral extensions.

* * * * *